US011753118B1

(12) United States Patent
Wang et al.

(10) Patent No.: US 11,753,118 B1
(45) Date of Patent: Sep. 12, 2023

(54) SUBMERSIBLE BUOY DEVICE AND CONTROL METHOD THEREOF

(71) Applicant: First Institute of Oceanography, Ministry of Natural Resources, Qingdao (CN)

(72) Inventors: Huiwu Wang, Qingdao (CN); Qinglei Su, Qingdao (CN); Yanliang Guo, Qingdao (CN)

(73) Assignee: First Institute of Oceanography, Ministry of Natural Resources, Qingdao (CN)

( * ) Notice: Subject to any disclaimer, the term of this patent is extended or adjusted under 35 U.S.C. 154(b) by 0 days.

(21) Appl. No.: 17/947,166

(22) Filed: Sep. 18, 2022

(30) Foreign Application Priority Data

Apr. 12, 2022 (CN) ..... 202210376563.5

(51) Int. Cl.
*B63B 22/18* (2006.01)
*G10K 11/00* (2006.01)
*B63B 22/00* (2006.01)

(52) U.S. Cl.
CPC ..... *B63B 22/18* (2013.01); *B63B 22/00* (2013.01); *B63B 22/003* (2013.01); *G10K 11/006* (2013.01); *B63B 2022/006* (2013.01)

(58) Field of Classification Search
CPC ..... B63B 22/18; B63B 22/00; B63B 22/003; B63B 2022/006; G10K 11/006
See application file for complete search history.

(56) References Cited

U.S. PATENT DOCUMENTS

| | | | | |
|---|---|---|---|---|
| 7,310,287 | B2 * | 12/2007 | Ray | G01V 1/3808 367/188 |
| 9,574,760 | B1 | 2/2017 | Olsson | |
| 9,817,139 | B2 * | 11/2017 | Shimizu | H04B 13/02 |
| 10,569,839 | B1 * | 2/2020 | Thomson | G01V 1/166 |

(Continued)

FOREIGN PATENT DOCUMENTS

| | | | |
|---|---|---|---|
| CN | 105334408 | A | 2/2016 |
| CN | 205418034 | U | 8/2016 |
| CN | 108058795 | A | 5/2018 |

(Continued)

*Primary Examiner* — Ian J Lobo
(74) *Attorney, Agent, or Firm* — Nitin Kaushik

(57) ABSTRACT

Disclosed is a submersible buoy device and a control method thereof. The submersible buoy device includes an encapsulated housing, a watertight penetration socket, an underwater acoustic communication body, a data acquisition body, a control body and a mounting bracket. By integrally integrating the watertight penetration socket, the underwater acoustic communication body, the data acquisition body and the control body on the encapsulated housing, different types of multi-sensor data in the submersible buoy device can be automatically collected and processed. Adaptive scheduling and linkage control are carried out by the control body to the unity of each functional module, thereby achieving one-stop automatic operation of all measurement data to acoustic transmission communication. The present invention achieves the integration, automation and intelligent application of a plurality of functional modules, and alleviates the technical problems of high installation cost, low reliability and complex installation in the prior art.

7 Claims, 4 Drawing Sheets

(56) References Cited

U.S. PATENT DOCUMENTS

| | | | | |
|---|---|---|---|---|
| 11,525,932 | B2 * | 12/2022 | Rokkan | G01V 1/166 |
| 2018/0299239 | A1 | 10/2018 | Eitschberger et al. | |

FOREIGN PATENT DOCUMENTS

| | | | | |
|---|---|---|---|---|
| CN | 207427434 | U | 5/2018 | |
| CN | 209096980 | U | 7/2019 | |
| CN | 209814247 | U | 12/2019 | |
| CN | 112537425 | A | 3/2021 | |
| CN | 2014466014 | U | 10/2021 | |
| CN | 113759343 | A | 12/2021 | |
| CN | 215345345 | U | 12/2021 | |
| CN | 114132463 | A | 3/2022 | |
| CN | 114172590 | A | 3/2022 | |
| WO | WO2018299838 | A1 | 11/2018 | |
| WO | WO-2019018226 | A1 * | 1/2019 | B63B 1/048 |

* cited by examiner

SUBMERSIBLE BUOY DEVICE AND CONTROL METHOD THEREOF

CROSS-REFERENCE TO RELATED APPLICATIONS

The application claims priority to Chinese patent application No. 202210376563.5, filed on Apr. 12, 2022, the entire contents of which are incorporated herein by reference.

FIELD OF TECHNOLOGY

The present invention relates to the technical field of ocean observation equipment, in particular to a submersible buoy device and a control method thereof.

BACKGROUND

With the development of economy and the progress of science and technology, with the increasing demand of human beings for marine resources, marine environment plays an important role in oil and gas exploitation, marine fishery, marine disaster early warning and climate prediction. In order to better monitor and obtain marine environment and resources, countries all over the world have put forward and formulated corresponding marine development strategies one after another, and promoted marine development to a national level.

In recent years, the deep-sea submersible buoy observation system has been widely used in scientists' ocean investigation, and it is one of the important means to observe the ocean and obtain deep-sea in-situ multi-element data (such as current profile data, conductivity-temperature-depth data, etc.). At present, collecting and transmitting the multi-element data of underwater submersible buoy observation has gradually become the main application direction. In the prior art, the submersible observation and data transmission are composed of the following parts: measuring sensors (various types), data acquisition systems, communication control units and underwater communication devices. Each unit is independently sealed in the watertight pressure chamber to complete the corresponding functions, and the units are connected by watertight cables.

However, in the submersible buoy device in the prior art, each functional unit is separated from each other, so it is impossible to realize rapid configuration and adaptive connection for different application scenarios. Different units need to be configured and redeveloped in advance according to the application configuration, which will lead to high installation cost, low overall reliability of the system and complex installation and construction.

SUMMARY

The purpose of the present invention is to provide a submersible buoy device and a control method thereof, so as to alleviate the technical problems of high installation cost, low reliability and complex installation caused by the fact that each functional unit of the submersible buoy device is separated and independent from each other and different units need to be configured and redeveloped in advance according to application configuration in the prior art.

The present invention provides a submersible buoy device including:

an encapsulated housing provided with a seal chamber inside; a data acquisition body; a watertight penetration socket, one end of the watertight penetration socket penetrating the encapsulated housing and the watertight penetration socket being hermetically connected to the encapsulated housing, one end of the watertight penetration socket extending into the seal chamber being electrically connected to the data acquisition body and the other end of the watertight penetration socket being configured to connect the control body to an external sensor; a mounting bracket; and an underwater acoustic communication body, one end of the underwater acoustic communication body penetrating the encapsulated housing and the underwater acoustic communication body being hermetically connected to the encapsulated housing, an end of the underwater acoustic communication body extending into the seal chamber being electrically connected to the data acquisition body and the control body, respectively, wherein either of the data acquisition body, the control body and the mounting bracket is located within the seal chamber, the mounting bracket is internally connected to the encapsulated housing, and the data acquisition body and the control body are mounted to the mounting bracket.

In a preferred embodiment of the present invention, the encapsulated housing includes a fixed housing; and a first end cover and a second end cover located at two ends of the fixed housing, respectively, and the first end cover and the second end cover being hermetically connected to the fixed housing so that the seal chamber is formed inside the fixed housing, wherein the second end cover is provided with a first through hole, one end of the watertight penetration socket penetrates through the first through hole so that the watertight penetration socket is connected to the second end cover, and the watertight penetration socket is hermetically connected to the first through hole.

In a preferred embodiment of the present invention, the underwater acoustic communication body includes an underwater acoustic communication control board and an underwater acoustic communication transducer;

the first end cover is provided with a second through hole, one end of the underwater acoustic communication transducer penetrates through the second through hole, the other end of the underwater acoustic communication transducer is attached to the surface of the second end cover, the underwater acoustic communication transducer is connected to the first end cover, and the underwater acoustic communication transducer is hermetically connected to the second through hole;

the underwater acoustic communication control board is arranged in the seal chamber, the underwater acoustic communication control board is mounted to the mounting bracket, and the underwater acoustic communication control board is electrically connected to the underwater acoustic communication transducer through enameled wires.

In the preferred embodiment of the present invention, the second through hole includes a stepped slot;

one end of the underwater acoustic communication transducer extending into the seal chamber is seated in the stepped slot, and the other end of the underwater acoustic communication transducer is fitted and fixed with the surface of the first end cover.

In a preferred embodiment of the present invention, the submersible buoy device further includes a first sealing body; the underwater acoustic communication transducer is provided with a first sealing groove, the first end cover is provided with a second sealing groove at a side facing away from the seal chamber, the second sealing groove is sleeved outside the second through hole, and the first sealing body is accommodated in either of the first sealing groove and the second sealing groove; and the first sealing groove has an inclined surface from one end of the first sealing groove away from the second sealing groove to the other end of the first sealing groove, the first sealing body abuts against the inclined surface, and the inclined surface has a movement trend that causes the first sealing body to press the second sealing groove.

In a preferred embodiment of the present invention, the submersible buoy device further includes:

a second sealing body located between the second end cover and the watertight penetration socket, the second sealing body sealing the watertight penetration socket and the first through hole through the end face at an end face;

a third sealing body provided in a plurality, the plurality of third sealing bodies being sequentially sleeved on an outside of the first end cover, and the third sealing body being located between the first end cover and the fixed housing;

a fourth sealing body provided in a plurality, the plurality of the fourth sealing bodies being sequentially sleeved on an outside of the second end cover, and the fourth sealing body being located between the second end cover and the fixed housing.

In the preferred embodiment of the present invention, the submersible buoy device further includes:

a first guardrail connected to a side of the first end cover away from the fixed housing, and a distance between the first guardrail and the first end cover being larger than a height of the underwater acoustic communication transducer extending out of the first end cover; and a second guardrail connected to a side of the second end cover away from the fixed housing, and a distance between the second guardrail and the second end cover being larger than a height of the watertight penetration socket extending out of the second end cover.

In the preferred embodiment of the present invention, two ends of the watertight penetration socket are respectively provided with a wiring terminal and a sealing socket, the watertight penetration socket is electrically connected to the data acquisition body through the wiring terminal and flat wires, and the watertight penetration socket is configured for electrically connecting with an external sensor through the sealing socket.

In the preferred embodiment of the present invention, the encapsulated housing is made of titanium alloy material;

the fixed housing and the first end cover are fixedly connected by a titanium alloy bolt, and the fixed housing and the second end cover are fixedly connected by the titanium alloy bolt.

The present invention provides a control method based on the submersible buoy device, including:

establishing a communication connection by connecting a watertight penetration socket with a sensor;

transporting information detected by the sensor to a control body by using a data acquisition body capable of storing received information;

verifying, by the control body, the received information;

starting an underwater acoustic communication body, and converting the data verified by the control body into digital/analog signals; and converting the analog signals into acoustic signals for acoustic transmission communication.

The present invention provides a submersible buoy device, which includes an encapsulated housing, a watertight penetration socket, an underwater acoustic communication body, a data acquisition body, a control body and a mounting bracket. The data acquisition body, the control body and the mounting bracket are all located in the seal chamber, and the mounting bracket is used to complete the installation of the data acquisition body and the control body. On the basis of sealing connection between the watertight penetration socket and the encapsulated housing, the watertight penetration socket can also be electrically connected to the data acquisition body and connected to external sensors. At the same time, the underwater acoustic communication body is hermetically connected to the encapsulated housing, the underwater acoustic communication body is electrically connected to the data acquisition body and the control body, respectively. By integrally integrating the watertight penetration socket, the underwater acoustic communication body, the data acquisition body and the control body on the encapsulated housing, it can automatically collect and process different types of multi-sensor data in the submersible buoy device. Adaptive scheduling and linkage control are carried out by the control body to the unity of each functional module, thereby achieving one-stop automatic operation of all measurement data to acoustic transmission communication. The present invention achieves the integration, automation and intelligent application of a plurality of functional modules, and alleviates the technical problems of high installation cost, low reliability and complex installation caused by the fact that each functional unit of the submersible buoy device is separated from each other and needs to be set and redeveloped in advance according to the application configuration in the prior art.

BRIEF DESCRIPTION OF THE DRAWINGS

In order to more clearly illustrate specific embodiments of the present invention or technical solutions in the prior art, the following will briefly introduce the drawings that are desired to be used in the description of the embodiments or prior art. Obviously, the drawings in the following description are some embodiments of the present invention, and other drawings may also be obtained according to these drawings without exerting inventive effort by those ordinarily skilled in the art.

Reference signs: 100—encapsulated housing; 101—fixed housing; 102—first end cover; 103—second end cover; 200—watertight penetration socket; 300—underwater acoustic communication body; 301—underwater acoustic communication control board; 302—underwater acoustic communication transducer; 312—first sealing groove; 400—data acquisition body; 500—control body; 600—mounting bracket; 700—third sealing body; 800—fourth sealing body; 900—first guardrail; 110—second guardrail.

DESCRIPTION OF THE EMBODIMENTS

A clear and complete description of the technical solution of the present invention will be made below in conjunction with the drawings. Obviously, the described embodiments are part of the embodiments of the present invention, but not all of them. Based on the embodiments of the present invention, all other embodiments obtained by those ordinarily skilled in the art without exerting creative effort fall within the scope of protection of the present invention.

Figure 1:
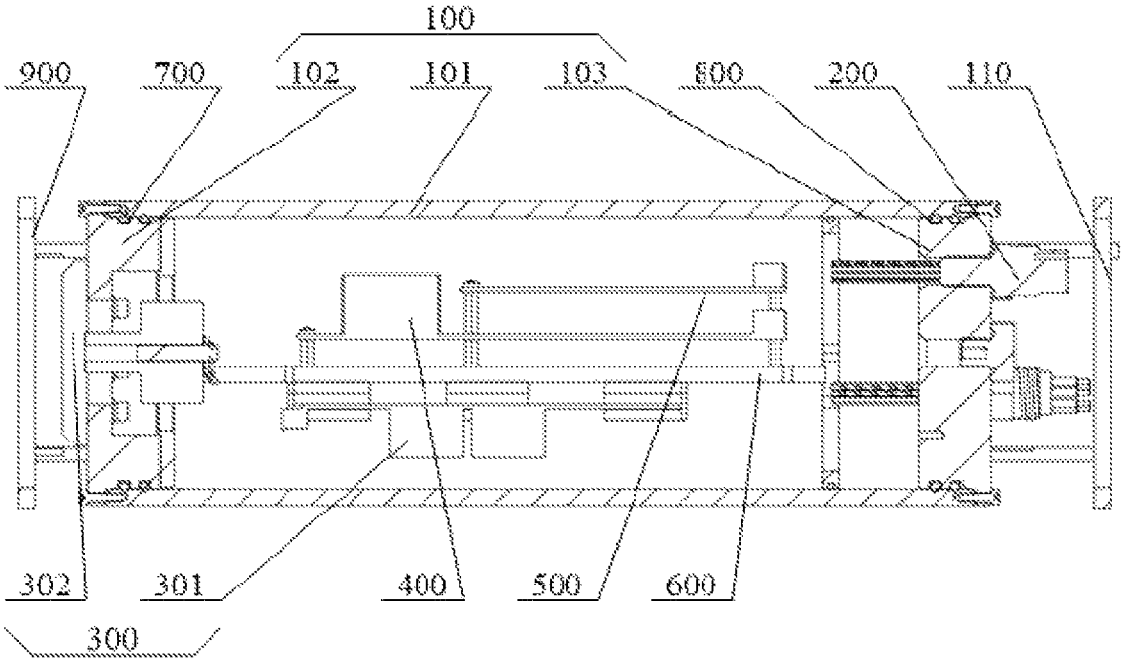
FIG. 1 is a schematic diagram of an overall structure of a submersible buoy device provided by an embodiment of the present invention.
Figure 2:
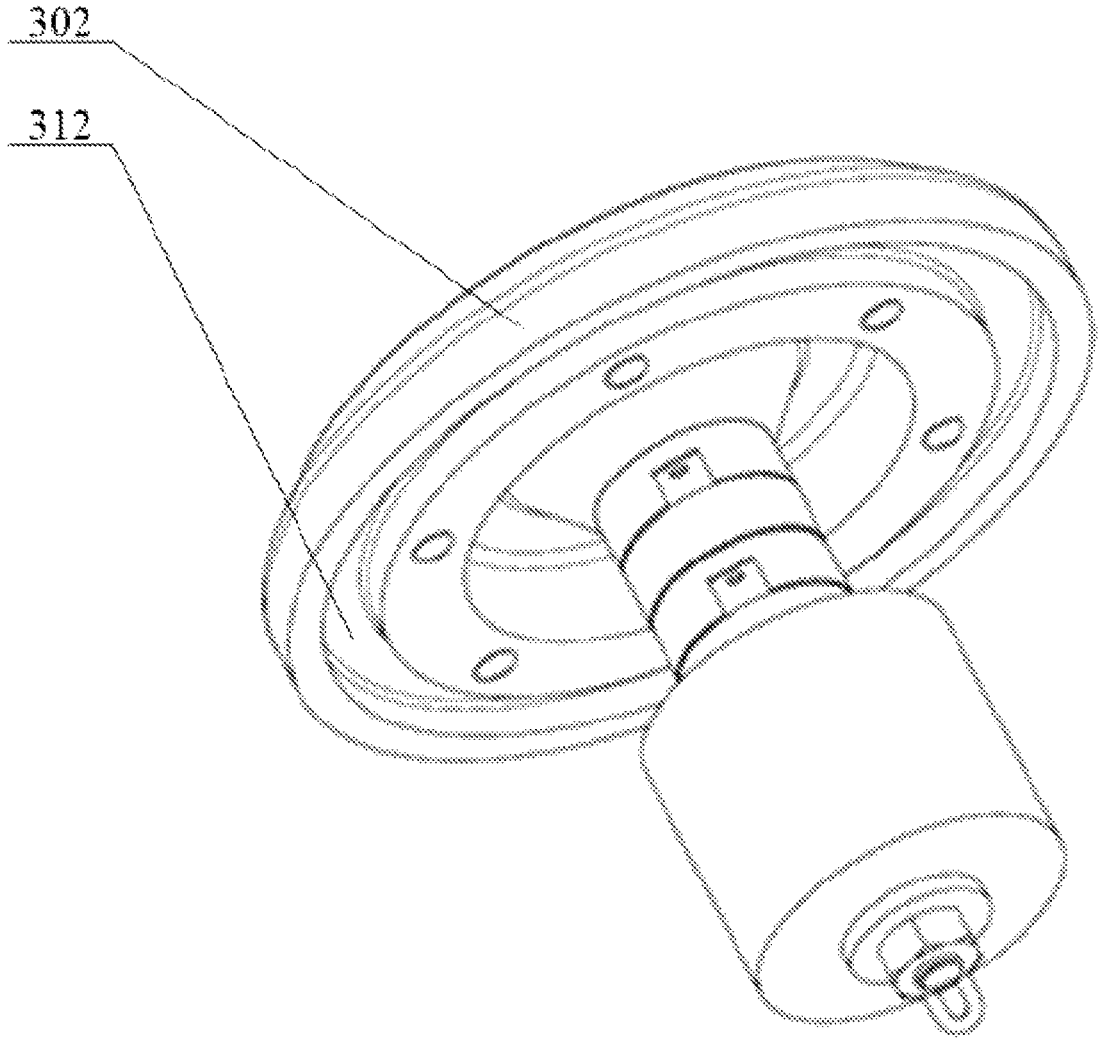
FIG. 2 is a structural schematic diagram of an underwater acoustic communication transducer of the submersible buoy device provided by the embodiment of the present invention.
Figure 3:
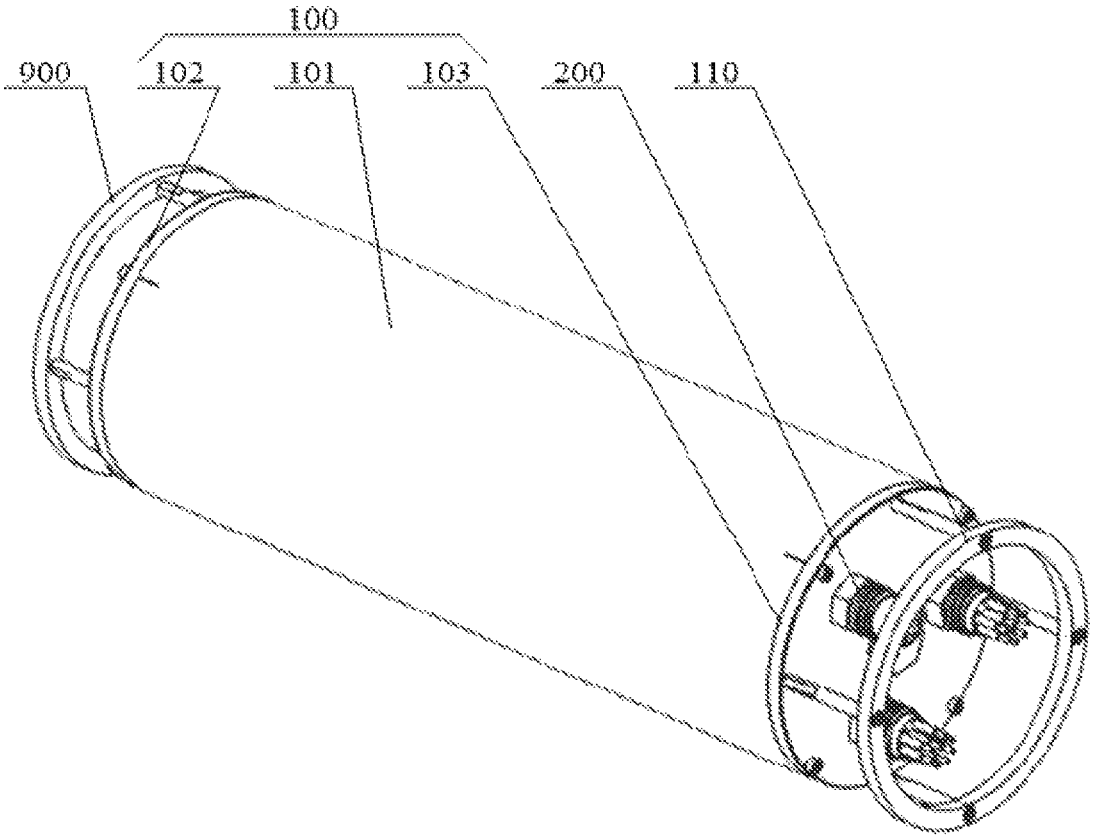
FIG. 3 is a schematic diagram of an overall structure of external appearance of the submersible buoy device provided by the embodiment of the present invention.
Figure 4:
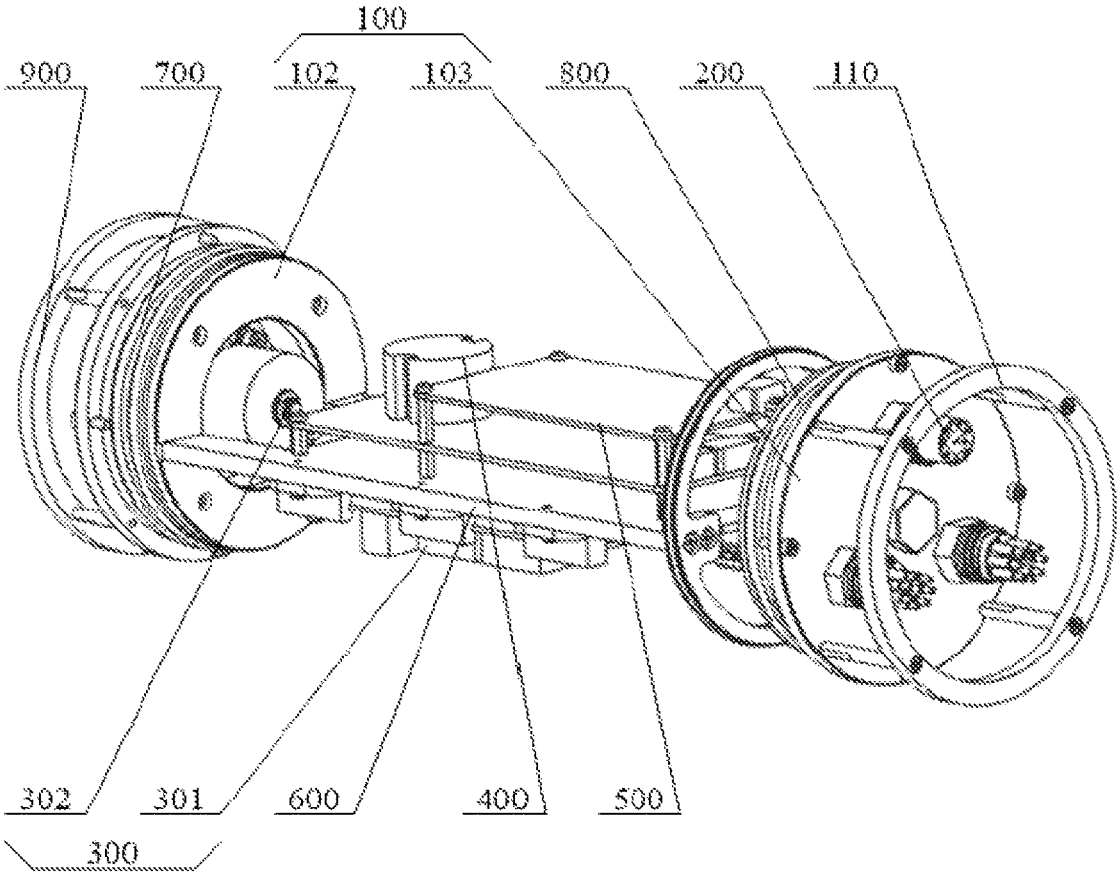
FIG. 4 is a schematic diagram of the internal structure of the submersible buoy device provided by the embodiment of the present invention.

As shown in FIGS. 1-4, the present invention provides a submersible buoy device, which includes an encapsulated housing 100, a watertight penetration socket 200, an underwater acoustic communication body 300, a data acquisition body 400, a control body 500 and a mounting bracket 600. The encapsulated housing 100 is provided with a seal chamber in which the data acquisition body 400, the control body 500 and the mounting bracket 600 are all located, and the mounting bracket 600 is connected to inside of the encapsulated housing 100, the data acquisition body 400 and the control body 500 are both mounted to the mounting bracket 600. One end of the watertight penetration socket 200 penetrates the encapsulated housing 100, and the watertight penetration socket 200 is hermetically connected to the encapsulated housing 100, one end of the watertight penetration socket 200 extending into the seal chamber is electrically connected to the data acquisition body 400, and the other end of the watertight penetration socket 200 is connected to an external sensor. One end of the underwater acoustic communication body 300 penetrates the encapsulated housing 100, and the underwater acoustic communication body 300 is hermetically connected to the encapsulated housing 100, one end of the underwater acoustic communication body 300 extending into the seal chamber is electrically connected to the data acquisition body 400 and the control body 500, respectively.

It should be noted that the submersible buoy device provided by the embodiment belongs to an integrated device for data acquisition, control assembly and underwater acoustic communication transmission of multiple sensors. Specifically, the encapsulated housing 100 may form a watertight pressure chamber, the data acquisition body 400 and the control body 500 are fixed in the seal chamber of the encapsulated housing 100 by the mounting bracket 600, the watertight penetration socket 200 is hermetically mounted to the encapsulated housing 100, the watertight penetration socket 200 can serve as a connecting body of an external sensor, the external sensor and the data acquisition body 400 are electrically connected in a watertight pressure-resistant manner by using the watertight penetration socket 200, and the underwater acoustic communication body 300 is hermetically mounted in the encapsulated housing 100. The underwater acoustic communication body 300 can be electrically connected to the control body 500 in a watertight pressure-resistant manner, thereby completing the power supply, control signal and data connection between the external sensor and the power supply, which achieves the application of multifunctional integration, avoids the risk of water leakage and wrong connection in split design, overcomes the fact that each functional unit is independent of each other in the prior art and the defects that the functions units cannot be uniformly and rapidly set and applied to different practical scenarios. The present invention has the advantages of achieving the integrated, automatic and intelligent application of a plurality of functional modules, avoiding the uncertainty caused by the independent setting and system matching of each module by users, improving the use efficiency and reliability, having high integration level of the whole machine and small overall size. The installation convenience and the operation practicability in the deep-sea use scene are improved.

It should be noted that the data acquisition body 400 provided in this embodiment can adopt a data acquisition and storage board, and the control body 500 can adopt a system general control board. The models of the data acquisition body 400 and the control body 500 can adopt structures supported by the submersible buoy device, which will not be repeated here.

The present invention provides a submersible buoy device, which includes an encapsulated housing 100, a watertight penetration socket 200, an underwater acoustic communication body 300, a data acquisition body 400, a control body 500 and a mounting bracket 600. The data acquisition body 400, the control body 500 and the mounting bracket 600 are all located in the seal chamber, and the mounting bracket 600 is used to complete the installation of the data acquisition body 400 and the control body 500. On the basis of sealing connection between the watertight penetration socket 200 and the encapsulated housing 100, the watertight penetration socket 200 can also be electrically connected to the data acquisition body 400 and connected to external sensors. At the same time, the underwater acoustic communication body 300 is hermetically connected to the encapsulated housing 100, the underwater acoustic communication body 300 is electrically connected to the data acquisition body 400 and the control body 500, respectively. By integrally integrating the watertight penetration socket 200, the underwater acoustic communication body 300, the data acquisition body 400 and the control body 500 on the encapsulated housing 100, it can automatically collect and process different types of multi-sensor data in the submersible buoy device. Adaptive scheduling and linkage control are carried out by the control body 500 to the unity of each functional module, thereby achieving one-stop automatic operation of all measurement data to acoustic transmission communication. The present invention achieves the integration, automation and intelligent application of a plurality of functional modules, and alleviates the technical problems of high installation cost, low reliability and complex installation caused by the fact that each functional unit of the submersible buoy device is separated from each other and needs to be set and redeveloped in advance according to the application configuration in the prior art.

Further, on the basis of the above embodiments, in the preferred embodiment of the present invention, the encapsulated housing 100 includes a fixed housing 101, a first end cover 102, and a second end cover 103. The first end cover 102 and the second end cover 103 are respectively positioned at both ends of the fixed housing 101, and the first end cover 102 and the second end cover 103 are respectively hermetically connected to the fixed housing 101 so that a seal chamber is formed inside the fixed housing 101. The second end cover 103 is provided with a first through hole, one end of the watertight penetration socket 200 penetrates through the first through hole so that the watertight penetration socket 200 is connected to the second end cover 103, and the watertight penetration socket 200 is hermetically connected to the first through hole.

In the preferred embodiment of the present invention, the encapsulated housing 100 is made of titanium alloy. The fixed housing 101 and the first end cover 102 are fixedly connected by titanium alloy bolts, and the fixed housing 101 and the second end cover 103 are fixedly connected by the titanium alloy bolts.

In this embodiment, the fixed housing 101 may be a drum housing, the first end cover 102 and the second end cover 103 may be hermetically connected to both ends of the drum housing. Preferably, the fixed housing 101 may be a titanium alloy drum housing, the first end cover 102 is a titanium alloy top end cover, the second end cover 103 is a titanium alloy bottom end cover, the titanium alloy top end cover and the titanium alloy drum housing are mechanically fixed and connected by titanium alloy bolts, the titanium alloy bottom end cover and the titanium alloy drum housing are mechanically connected by the titanium alloy bolts, and the titanium alloy material can ensure the pressure resistance of the encapsulated housing 100 in the deep sea. At the same time, the fixed housing 101 is tightly mechanically connected to the first end cover 102 and the second end cover 103 respectively by using the titanium alloy bolts, so that the demand of fixing the data acquisition body 400 and the control body 500 in the seal chamber of the encapsulated housing 100 through the mounting bracket 600 can be met. Alternatively, the mounting bracket 600 may be fixedly connected to the inner wall of the first end cover 102 or the second end cover 103 by bolting, so that the mounting bracket 600 can be fixed inside the seal chamber of the encapsulated housing 100.

In the preferred embodiment of the present invention, the underwater acoustic communication body 300 includes an underwater acoustic communication control board 301 and an underwater acoustic communication transducer 302. The first end cover 102 is provided with a second through hole, one end of the underwater acoustic communication transducer 302 penetrates through the second through hole, the other end of the underwater acoustic communication transducer 302 is attached to the surface of the second end cover 103. The underwater acoustic communication transducer 302 is connected to the first end cover 102, and the underwater acoustic communication transducer 302 is hermetically connected to the second through hole. The underwater acoustic communication control board 301 is located in the seal chamber, and is mounted on the mounting bracket 600. The underwater acoustic communication control board 301 is electrically connected to the underwater acoustic communication transducer 302 through enameled wires.

In this embodiment, the underwater acoustic communication control board 301 is mounted on the mounting bracket 600, and the data acquisition body 400 and the control body 500 are electrically connected through an inter-board connector of the mounting bracket 600 and is electrically connected to the underwater acoustic communication control board 301 through wires to complete power supply, control signal and data connection. The underwater acoustic communication transducer 302 can convert signals received by the underwater acoustic communication control board 301 from the control body 500 into signals for transmission in seawater by covering digital signal into analog acoustic signals. One end of the underwater acoustic communication transducer 302 penetrates through the first end cover 102, and the underwater acoustic communication transducer 302 is hermetically connected to the first through hole of the first end cover 102, that is, the underwater acoustic communication transducer 302 can realize the waterproof sealing function between the underwater acoustic communication transducer 302 and the seal chamber on the basis of ensuring the electrical connection with the underwater acoustic communication control board 301.

In the preferred embodiment of the present invention, the second through hole includes a stepped slot. One end of the underwater acoustic communication transducer 302 extending into the seal chamber is seated in the stepped slot, and the other end of the underwater acoustic communication transducer 302 is fitted and fixed with the surface of the first end cover 102.

In a preferred embodiment of the present invention, the submersible buoy device further includes a first sealing body; the underwater acoustic communication transducer 302 is provided with a first sealing groove 312, the first end cover 102 is provided with a second sealing groove at a side facing away from the seal chamber, the second sealing groove is sleeved outside the second through hole, and the first sealing body is accommodated in either of the first sealing groove 312 and the second sealing groove. The first sealing groove 312 has an inclined surface from one end of the first sealing groove away from the second sealing groove to the other end of the first sealing groove, the first sealing body abuts against the inclined surface, and the inclined surface has a movement trend that causes the first sealing body to press the second sealing groove.

In this embodiment, the first sealing body can adopt an o-shaped sealing ring. Specifically, the underwater acoustic communication transducer 302 extending into one end of the seal chamber is seated in the stepped slot. The underwater acoustic communication transducer 302 may include two parts, part of the underwater acoustic communication transducer 302 is inserted in the second through hole along the side of the seal chamber facing away from the first end cover 102, the other part of the underwater acoustic communication transducer 302 can be mechanically fixed connected to the part inserted with the second through hole, and the underwater acoustic communication transducer 302 located in the stepped slot can be electrically connected to the underwater acoustic communication control board 301. When the underwater acoustic communication transducer 302 is connected to the first end cover 102, the o-ring is clamped inside the first sealing groove 312 and the second sealing groove, so that the underwater acoustic communication transducer 302 is tightly attached to the side of the first end cover 102 deviating from the seal chamber; Further, an inclined surface is arranged in the first sealing groove 312, The inclined surface is in contact with an O-shaped sealing ring. The inclined surface can better exert extrusion force on the O-shaped sealing ring while the first end cover 102 is under the action of deep sea water pressure, the inclined surface exerts a deflection force under the elastic force of the O-shaped sealing ring, so that the first sealing body can squeeze the second sealing groove along the oblique force, thereby better ensuring that the end face sealing mode of the O-shaped sealing ring achieves the pressure-resistant and waterproof sealing functions.

In a preferred embodiment of the present invention, the submersible buoy device further includes a second sealing body, a third sealing body 700 and a fourth sealing body 800. The second sealing body located between the second end cover 103 and the watertight penetration socket 200, the second sealing body seals the watertight penetration socket 200 and the first through hole through the end face at an end face. The third sealing body 700 is provided in a plurality, the plurality of third sealing bodies 700 are sequentially sleeved on an outside of the first end cover 102, and the third sealing body 700 is located between the first end cover 102 and the fixed housing 101. The fourth sealing body 800 is provided in a plurality, the plurality of the fourth sealing bodies 800 are sequentially sleeved on an outside of the second end cover 103, and the fourth sealing body 800 is located between the second end cover 103 and the fixed housing 101.

In this embodiment, the second sealing body, the third sealing body 700, and the fourth sealing body 800 may each employ an O-ring. When the watertight penetration socket 200 penetrates through the first through hole, the end face of the watertight penetration socket 200 is attached to the surface of the second end cover 103. A sealing groove can be provided on the surface of the second end cover 103, and the second sealing body is clamped in the sealing groove on the basis that an inner diameter of the second sealing body is larger than an inner diameter of the first through hole, and the pressure-resistant and waterproof sealing functions are achieved by using the second sealing body in an O-shaped sealing ring with an end seal.

Alternatively, two third sealing bodies 700 may be provided, and the pressure-resistant and waterproof sealing functions are achieved by means of a radial sealing in which two O-rings are annularly sleeved on the outer side of the first end cover 102. Likewise, two fourth sealing bodies 800 may be provided, and the pressure-resistant and waterproof sealing functions may be achieved by means of a radial sealing in which two O-rings are annularly sleeved on the outer side of the second end cover 103.

It should be noted that as the encapsulated housing 100 is running in the deep sea, the underwater acoustic communication body 300 and the watertight penetration socket 200 will extend out of the end portions of the two ends of the encapsulated housing 100, in order to prevent the underwater acoustic communication body 300, the watertight penetration socket 200 and other electrical connecting wires from colliding with solid matter in the deep sea and causing unnecessary losses. In the preferred embodiment of the present invention, the submersible buoy device further includes a first guardrail 900 and a second guardrail 110. The first guardrail 900 is connected to a side of the first end cover 102 away from the fixed housing 101, and a distance between the first guardrail 900 and the first end cover 102 is larger than a height of the underwater acoustic communication transducer 302 extending out of the first end cover 102. The second guardrail 110 is connected to a side of the second end cover 103 away from the fixed housing 101, and a distance between the second guardrail 110 and the second end cover 103 is larger than a height of the watertight penetration socket 200 extending out of the second end cover 103.

Alternatively, the first guardrail 900 and the first end cover 102 can be connected in a variety of ways, such as plugging, riveting or bolting. Preferably, the first guardrail 900 and the first end cover 102 are connected by bolting. Similarly, the second guardrail 110 and the second end cover 103 may be connected in a variety of ways, such as plugging, riveting or bolting. Preferably, the second guardrail 110 and the second end cover 103 are connected by bolting.

In the preferred embodiment of the present invention, two ends of the watertight penetration socket 200 are respectively provided with a wiring terminal and a sealing socket, the watertight penetration socket 200 is electrically connected to the data acquisition body 400 through the wiring terminal and flat wires, and the watertight penetration socket 200 is configured for electrically connecting with an external sensor through the sealing socket.

In this embodiment, as that encapsulated housing 100 integrate all functional modules of data acquisition, system master control and acoustic communication, there is only a sensor data acquisition interface externally, the watertight penetration socket 200 is electrically connected through wiring terminals and flat wires, to complete the power supply and signal connection function between the data acquisition body 400 and the external sensor and the power supply unit. Each unit is connected by wires, which avoids the risk of water leakage and wrong connection in split design, achieves the simple operation of one-key setting and plug and play, is suitable for the rapid deployment of different sensor access and different application scenarios, and achieves the full-automatic operation from data acquisition to acoustic transmission.

The present invention provides a control method of a submersible buoy device based on the present invention, which includes: establishing a communication connection by connecting a watertight penetration socket 200 with a sensor; transporting information detected by the sensor to a control body 500 by using a data acquisition body 400 capable of storing received information; verifying, by the control body 500, the received information; starting an underwater acoustic communication body 300, and converting the data verified by the control body 500 into digital/analog signals; and converting the analog signals into acoustic signals for acoustic transmission communication.

In this embodiment, the RS232 serial communication connection is established with the watertight penetration socket 200 through the watertight cable, the data acquisition body 400 is responsible for acquiring and storing measurement data of all sensors, and sends the acquired data information to the control body 500 through the RS232 serial communication connection, after verifying the data acquired by the data acquisition body 400, the control body 500 controls the underwater acoustic communication control board 301 to start, and converts digital signals into analog acoustic signals through the underwater acoustic communication transducer 302 for transmission in seawater. The present invention provides a control method of a submersible buoy device, which can integrate multi-sensor data acquisition and underwater acoustic communication transmission, so as to overcome the defect that the independent functions units cannot be uniformly and rapidly set and applied to different practical scenarios. It can automatically collect and process different types of multi-sensor data in the submersible buoy device, can carry out adaptive scheduling and linkage control to the unity of each functional module, thereby achieving one-stop automatic operation of all measurement data to acoustic transmission communication. The present invention achieves the integration, automation and intelligent application of a plurality of functional modules, and avoids the uncertainty caused by the independent setting and system matching of each module by users, improving the use efficiency and reliability.

Finally, it should be noted that the above embodiments are only used to illustrate the technical solution of the present invention and not to limit it. Although the present invention has been described in detail with reference to the foregoing embodiments, it should be understood by those of ordinary skill in the art that the technical solution described in the foregoing embodiments can still be modified or some or all of the technical features thereof can be equivalently replaced. However, these modifications or substitutions do not depart the essence of the corresponding technical solution from the scope of the technical solution of each embodiment of the present invention.

What is claimed is:

1. A submersible buoy device comprising:

an encapsulated housing provided with a seal chamber inside;

a data acquisition body;

a watertight penetration socket having two ends, one end of the watertight penetration socket penetrating the encapsulated housing and the watertight penetration socket being hermetically connected to the encapsulated housing, the other end of the watertight penetration socket extending into the seal chamber being electrically connected to the data acquisition body and the other end of the watertight penetration socket being configured to connect a control body to an external sensor;

a mounting bracket; and an underwater acoustic communication body, one end of the underwater acoustic communication body penetrating the encapsulated housing and the underwater acoustic communication body being hermetically connected to the encapsulated housing, another end of the underwater acoustic communication body extending into the seal chamber being electrically connected to the data acquisition body and the control body, respectively, wherein any of the data acquisition body, the control body and the mounting bracket is located within the seal chamber, the mounting bracket is internally connected to the encapsulated housing, and the data acquisition body and the control body are mounted to the mounting bracket;

wherein the encapsulated housing comprises a fixed housing, and a first end cover and a second end cover located at two ends of the fixed housing, respectively, and the first end cover and the second end cover being hermetically connected to the fixed housing so that the seal chamber is formed inside the fixed housing, the second end cover is provided with a first through hole;

wherein the underwater acoustic communication body comprises an underwater acoustic communication transducer; the first end cover is provided with a second through hole, one end of the underwater acoustic communication transducer penetrates through the second through hole, the other end of the underwater acoustic communication transducer is attached to the surface of the second end cover, the underwater acoustic communication transducer is connected to the first end cover, and the underwater acoustic communication transducer is hermetically connected to the second through hole;

wherein the one end of the underwater acoustic communication transducer extends into the seal chamber, and the another end of the underwater acoustic communication transducer is fitted and fixed with the surface of the first end cover;

wherein the submersible buoy device further comprises a first sealing body; the underwater acoustic communication transducer is provided with a first sealing groove, the first end cover is provided with a second sealing groove at a side facing away from the seal chamber, the second sealing groove is sleeved outside the second through hole, and the first sealing body is accommodated in either of the first sealing groove and the second sealing groove; and wherein the first sealing groove has an inclined surface from one end of the first sealing groove away from the second sealing groove to the other end of the first sealing groove, the first sealing body abuts against the inclined surface, and the inclined surface has a movement trend that causes the first sealing body to press the second sealing groove;

wherein the watertight penetration socket is used with the external sensor to establish a communication connection;

wherein information detected by the external sensor is transported to the control body by using the data acquisition body capable of storing received information, the control body verifying the received information, the underwater acoustic communication body converts the data verified information by the control body into digital/analog signals; and the analog signals are thereafter converted into acoustic signals for acoustic transmission communication.

2. The submersible buoy device according to claim 1, wherein the second end cover is provided with the first through hole, one end of the watertight penetration socket penetrates through the first through hole so that the watertight penetration socket is connected to the second end cover, and the watertight penetration socket is hermetically connected to the first through hole.

3. The submersible buoy device according to claim 2, wherein the underwater acoustic communication body comprises an underwater acoustic communication control board arranged in the seal chamber, the underwater acoustic communication control board is mounted to the mounting bracket, and the underwater acoustic communication control board is electrically connected to the underwater acoustic communication transducer through enameled wires.

4. The submersible buoy device according to claim 3, wherein the submersible buoy device further comprises:

a second sealing body located between the second end cover and the watertight penetration socket, the second sealing body sealing the watertight penetration socket and the first through hole through the end face at an end face;

a third sealing body provided in a plurality, the plurality of third sealing bodies being sequentially sleeved on an outside of the first end cover, and the third sealing body being located between the first end cover and the fixed housing; and a fourth sealing body provided in a plurality, the plurality of the fourth sealing bodies being sequentially sleeved on an outside of the second end cover, and the fourth sealing body being located between the second end cover and the fixed housing.

5. The submersible buoy device according to claim 3, wherein the submersible buoy device further comprises:

a first guardrail connected to a side of the first end cover away from the fixed housing, and a distance between the first guardrail and the first end cover being larger than a height of the underwater acoustic communication transducer extending out of the first end cover; and a second guardrail connected to a side of the second end cover away from the fixed housing, and a distance between the second guardrail and the second end cover being larger than a height of the watertight penetration socket extending out of the second end cover.

6. The submersible buoy device according to claim 2, wherein the encapsulated housing comprises titanium alloy material; the fixed housing and the first end cover are fixedly connected by a titanium alloy bolt, and the fixed housing and the second end cover are fixedly connected by the titanium alloy bolt.

7. The submersible buoy device according to claim 1, wherein two ends of the watertight penetration socket are respectively provided with a wiring terminal and a sealing socket, the watertight penetration socket is electrically connected to the data acquisition body through the wiring terminal and flat wires, and the watertight penetration socket is configured for electrically connecting with an external sensor through the sealing socket.

* * * * *